US007743944B2

(12) United States Patent
Ho Fung et al.

(10) Patent No.: US 7,743,944 B2
(45) Date of Patent: Jun. 29, 2010

(54) CARTON HAVING DISPENSING CONFIGURATIONS

(75) Inventors: Charles F. Ho Fung, Woodstock, GA (US); Jean-Manuel Gomes, Marietta, GA (US); Barry D. Biddle, Marietta, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 79 days.

(21) Appl. No.: 11/767,871

(22) Filed: Jun. 25, 2007

(65) Prior Publication Data

US 2007/0295793 A1 Dec. 27, 2007

Related U.S. Application Data

(60) Provisional application No. 60/815,967, filed on Jun. 23, 2006.

(51) Int. Cl.
*B65D 5/72* (2006.01)
*B65D 17/00* (2006.01)

(52) U.S. Cl. ..... 221/305; 221/32

(58) Field of Classification Search ..... 221/1, 221/25, 30, 31, 32, 34, 37, 44, 45, 61, 62, 221/63, 64, 65, 68, 69, 86, 92, 97, 101, 102, 221/131, 152, 156, 176, 177, 186, 191, 194, 221/205, 239, 241, 242, 255, 256, 257, 281, 221/288, 291, 302, 303, 304, 305, 309, 311; 229/120.09, 120.011, 122.1, 235, 240, 242
See application file for complete search history.

(56) References Cited

U.S. PATENT DOCUMENTS

| | | | |
|---|---|---|---|
| 1,656,919 | A | 1/1928 | Marsh |
| 1,901,483 | A | 3/1933 | Ware, Jr. |
| 1,925,102 | A | 9/1933 | Levkoff |
| 2,027,079 | A | 1/1936 | Weiss |
| 2,141,743 | A | 12/1938 | Ethridge |
| 2,145,430 | A | 1/1939 | New |
| 2,152,079 | A | 3/1939 | Mott |
| 3,002,613 | A | 10/1961 | Merkel |
| 3,139,979 | A | 7/1964 | Russell |
| 3,215,332 | A | 11/1965 | Bess |
| 3,263,900 | A | 8/1966 | Link et al. |
| 3,276,665 | A | 10/1966 | Rasmussen |

(Continued)

FOREIGN PATENT DOCUMENTS

| | | |
|---|---|---|
| DE | 2 320 190 | 11/1973 |

(Continued)

OTHER PUBLICATIONS

Office Action mailed Jun. 11, 2009, for related U.S. Appl. No. 11/767,959.

(Continued)

*Primary Examiner*—Gene Crawford
*Assistant Examiner*—Kelvin L Randall, Jr.
(74) *Attorney, Agent, or Firm*—Womble Carlyle Sandridge & Rice, PLLC

(57) ABSTRACT

A carton can be placed in a dispensing configuration by separating the carton into carton sections. The carton sections may be connected by a hinge that allows the carton sections to stand side-by-side.

16 Claims, 7 Drawing Sheets

U.S. PATENT DOCUMENTS

| | | | | | |
|---|---|---|---|---|---|
| 3,280,968 | A | | 10/1966 | Craine | |
| 3,653,495 | A | | 4/1972 | Gray | |
| 3,759,378 | A | | 9/1973 | Werth | |
| 3,786,914 | A | | 1/1974 | Beutler | |
| 3,884,438 | A | | 5/1975 | Ross | |
| 4,008,849 | A | | 2/1977 | Baber | |
| 4,113,100 | A | | 9/1978 | Soja | |
| 4,519,538 | A | * | 5/1985 | Omichi | 206/746 |
| 4,558,785 | A | | 12/1985 | Gordon | |
| 4,742,917 | A | | 5/1988 | Bornwasser | |
| 4,773,541 | A | | 9/1988 | Riddell | |
| 4,793,487 | A | | 12/1988 | Bentsen et al. | |
| 4,815,609 | A | | 3/1989 | Kiedaisch | |
| 4,886,160 | A | | 12/1989 | Kilgerman | |
| 5,181,650 | A | | 1/1993 | Hollander et al. | |
| 5,368,194 | A | * | 11/1994 | Oliff et al. | 221/305 |
| 5,699,957 | A | | 12/1997 | Blin et al. | |
| 5,722,583 | A | * | 3/1998 | Focke et al. | 229/120.011 |
| 5,788,117 | A | * | 8/1998 | Zimmanck | 221/285 |
| 5,842,576 | A | | 12/1998 | Snow | |
| 5,857,570 | A | * | 1/1999 | Brown | 206/427 |
| 5,878,947 | A | * | 3/1999 | Hoy et al. | 229/122.1 |
| 5,881,884 | A | | 3/1999 | Podosek | |
| 5,921,398 | A | | 7/1999 | Carroll | |
| 5,927,498 | A | | 7/1999 | Saam | |
| 5,979,749 | A | | 11/1999 | Bozich | |
| D431,462 | S | | 10/2000 | Menaged et al. | |
| 6,129,211 | A | | 10/2000 | Prakken et al. | |
| 6,135,289 | A | | 10/2000 | Miller | |
| 6,419,152 | B1 | | 7/2002 | Tokarski | |
| 6,435,351 | B1 | | 8/2002 | Gibb | |
| 6,478,159 | B1 | | 11/2002 | Taylor | |
| 6,510,982 | B2 | | 1/2003 | White | |
| 6,523,692 | B2 | * | 2/2003 | Gregory | 206/746 |
| 6,913,189 | B2 | * | 7/2005 | Oliff et al. | 229/120.011 |
| 6,923,365 | B2 | * | 8/2005 | Auclair et al. | 229/120.011 |
| 7,021,468 | B2 | | 4/2006 | Cargile | |
| 7,225,930 | B2 | | 6/2007 | Ford et al. | |
| 7,328,834 | B2 | * | 2/2008 | Harrelson | 229/242 |
| 2001/0001447 | A1 | | 5/2001 | Gregory | |
| 2002/0043554 | A1 | | 4/2002 | White | |
| 2002/0170845 | A1 | * | 11/2002 | Oliff | 206/749 |
| 2004/0099570 | A1 | | 5/2004 | Cargile | |
| 2005/0092649 | A1 | * | 5/2005 | Ford et al. | 206/736 |
| 2005/0199690 | A1 | * | 9/2005 | Peterson | 229/122.1 |
| 2006/0243739 | A1 | * | 11/2006 | Sherman et al. | 221/309 |
| 2006/0266815 | A1 | | 11/2006 | Coltri-Johnson et al. | |
| 2007/0000934 | A1 | * | 1/2007 | Wolpow | 221/31 |

FOREIGN PATENT DOCUMENTS

| | | | |
|---|---|---|---|
| EP | 0 704 386 | A1 | 4/1996 |
| FR | 1.379.931 | | 12/1963 |
| GB | 1 218 016 | | 1/1971 |
| WO | WO 98/31593 | | 7/1998 |
| WO | WO 03/082686 | A1 | 10/2003 |
| WO | WO 2004/063031 | A1 | 7/2004 |
| WO | WO 2005/110866 | A1 | 11/2005 |

OTHER PUBLICATIONS

Response to Office Action mailed Dec. 24, 2008, filed Mar. 30, 2009 in related U.S. Appl. No. 11/767,959.

* cited by examiner

CARTON HAVING DISPENSING CONFIGURATIONS

PRIORITY APPLICATION

This application claims the benefit of U.S. Provisional Application No. 60/815,967, filed Jun. 23, 2006, which is hereby incorporated by reference in its entirety.

RELATED APPLICATION

This application is related to U.S. Provisional Application No. 60/816,106, filed Jun. 23, 2006.

BACKGROUND

Enclosed cartons with dispensing features have been used in the past. Many such cartons include article dispensers defined by lines of disruption such as tear lines, cuts, score lines, and fold lines. A dispenser may be removable from a carton to create an opening from which articles can be removed from the carton. In some cartons, however, the dispenser may not provide sufficient access to all of the containers within the carton, which may render it difficult to remove all of the containers from the carton.

SUMMARY

The present invention generally relates to a carton accommodating a plurality of articles. The carton includes a tear feature that allows the carton to be placed in a first dispensing configuration. In the first dispensing configuration, the carton is separated into two sections, with each carton section accommodating a portion of the articles. The carton can include a hinge connecting the two carton sections and about which the carton sections are pivoted to place the carton in the first dispensing configuration.

According to an aspect of the invention, the carton sections may be completely separated from one another to place the carton in a dispensing configuration.

According to yet another aspect of the invention, one or both of the carton sections may be provided with a dispenser pattern that defines a dispenser section. The dispenser section allows a carton section to be placed in a second dispensing configuration.

Other aspects, features, and details of the present invention can be more completely understood by reference to the following detailed description of exemplary embodiments taken in conjunction with the drawings and from the appended claims.

BRIEF DESCRIPTION OF THE DRAWING FIGURES

According to common practice, the various features of the drawings discussed below are not necessarily drawn to scale. Dimensions of various features and elements in the drawings may be expanded or reduced to more clearly illustrate the embodiments of the invention.

DETAILED DESCRIPTION

Figure 1:
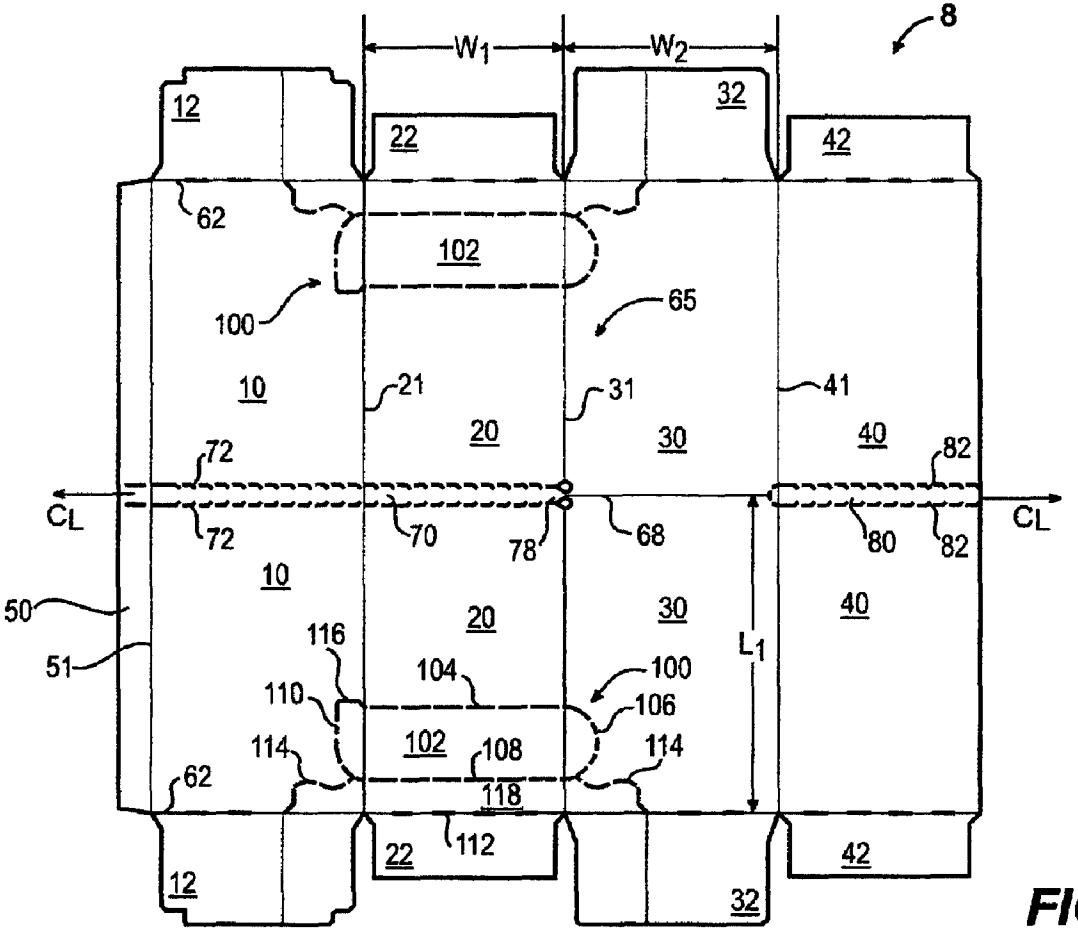
FIG. 1 is a plan view of a blank from which a carton according to a first embodiment of the invention is formed.

The present invention generally relates to cartons capable of being placed in dispensing configurations by separating the carton into carton sections. The present invention can be used, for example, in cartons that contain articles or other products such as, for example, food and beverages. The articles can also include beverage containers such as, for example, cans, bottles, PET containers, or other containers such as those used in packaging foodstuffs. For the purposes of illustration and not for the purpose of limiting the scope of the present invention, the following detailed description describes generally cylindrical beverage containers as disposed within the illustrated carton embodiments.

To facilitate understanding and explanation of the blank of the present invention, the elements and numerals described herein utilize the terms "end" and "side" to distinguish portions of the carton and of the blank. These conventions are included merely for ease of explanation and understanding of the present description, however, and should not be limiting in any manner. The descriptions of the panels as "end" and "side" etc., also can be referred to as "first," "second," etc. The terms "end" and "side" are not intended to connote relative size differences between elements in the drawing figures.

FIG. 1 is a plan view of the exterior or print side of a blank 8 that can be used to form a carton 150 (illustrated in FIG. 2) according to a first embodiment of the invention. As shown in FIG. 1, the blank 8 may be symmetric or nearly symmetric about a longitudinal center line $C_L$. Therefore, certain elements in the drawing figures are indicated by like or similar reference numerals in order to reflect the longitudinal symmetry. The blank 8 comprises a pair of first side panels 10, each first side panel 10 being foldably connected to a second side panel 20 at a first transverse fold line 21, a pair of third side panels 30, each third side panel 30 being foldably connected to a second side panel 20 at a second transverse fold line 31, and a pair of fourth side panels 40, each fourth side panel 40 being foldably connected to a third side panel 30 at a third transverse fold line 41. An adhesive flap 50 may be foldably connected at a fourth transverse fold line 51.

Each first side panel 10 is foldably connected at one end to a first end flap 12. Each second side panel 20 is foldably connected at one end to a second end flap 22. Each third side panel 30 is foldably connected at one end to a third end flap 32. Each fourth side panel 40 is foldably connected at one end to a fourth end flap 42. The end flaps 12, 22, 32, 42 may be arranged along marginal areas of the blank 8, and may be foldably connected along longitudinally extending fold lines 62. The longitudinal fold lines 62 may be straight or substantially straight fold lines, or may be offset at one or more locations to account for, for example, blank thickness. When the carton 150 is erected, the end flaps 12, 22, 32, 42 close each end of the carton 150.

According to one aspect of the first embodiment, the blank 8 includes a tear pattern 65 of lines of disruption that bifurcate the blank and allow the erected carton 150 (FIG. 2) constructed from the blank to be placed in a first dispensing configuration. The tear pattern 65 includes a first tear feature 70 that separates the pairs of side panels 10, 20 and extends adjacent to a longitudinal hinge line 68 that separates (e.g., defines a boundary between) and foldably connects the side panels 30. The first tear feature 70 can be, for example, a tear strip defined by spaced breachable lines of disruption 72, which may be tear lines. A tear tab 78 can be provided at the end of the first tear feature 70. The hinge line 68 extends adjacent to a second tear feature 80 that separates the side panels 40. The second tear feature 80 can be, for example, a tear strip defined by spaced breachable lines of disruption 82.

A dispenser pattern 100 can be formed in one or both halves of the blank 8. Each dispenser pattern 100 is comprised of lines of disruption defining a dispenser section 102. Each dispenser pattern 100 includes a longitudinally extending upper portion 104, a first side portion 106, a longitudinally extending lower portion 108, and a second side portion 110. An access flap 116 can be defined at one corner of the dispenser section 102. The dispenser pattern 100 also includes a base hinge line 112 and curved base lines 114 that in part define a pivot portion 118 at the base of the dispenser section 102.

The lines 72, 82, 104, 106, 108, 110, 114 can be breachable lines of disruption formed from continuous or substantially continuous tear lines formed by, for example, scores, creases, cuts, gaps, cut/creases, perforations, offset cuts, and overlapping and/or sequential combinations thereof. If cuts are used to form the tear lines 72, 82, 104, 106, 108, 110, 114, the cuts may be, for example, interrupted by breachable nicks. The hinge line 68 can be, for example, any line of disruption between the panels 30 that facilitates hinged folding or pivoting of the blank 8.

Figure 6:
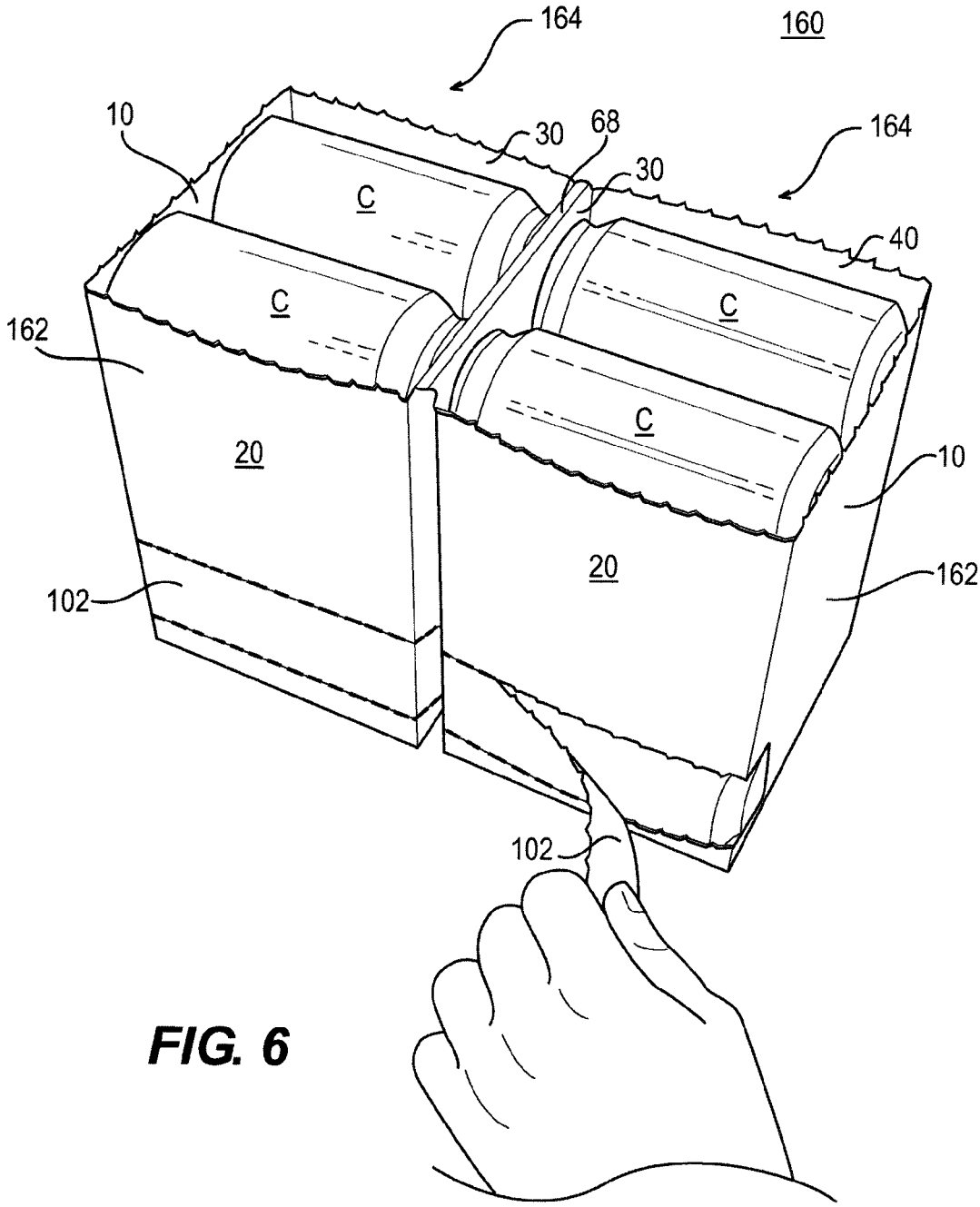
FIG. 6 illustrates the first carton embodiment in the first dispensing configuration.
Figure 7:
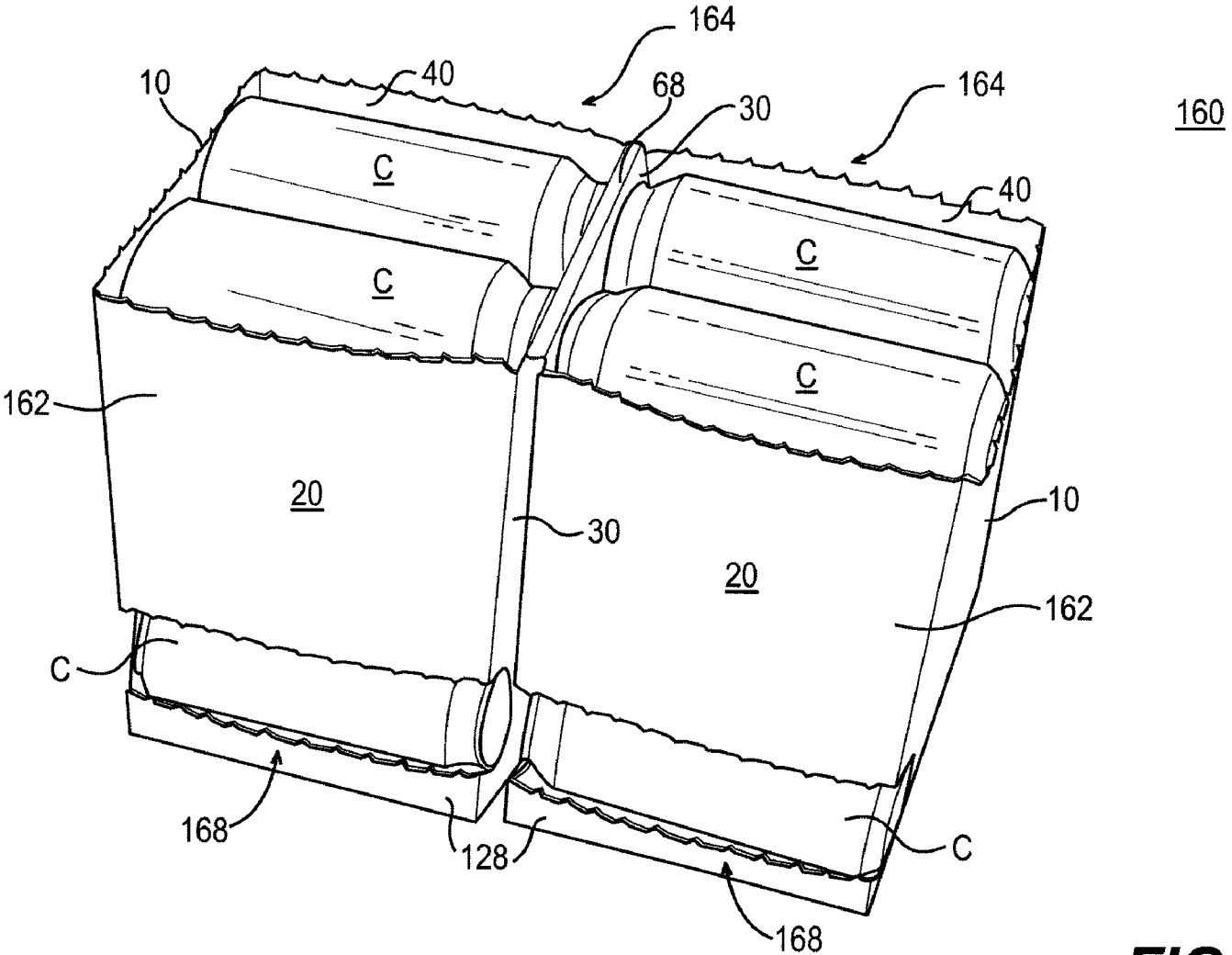
FIG. 7 illustrates the first carton embodiment in a second dispensing configuration.

The dimensions of the blank 8 may be selected to accommodate characteristic dimensions of articles to be accommodated within the carton 150. For example, in one embodiment, the side panels 20 (as well as the side panels 40) can have a width $W_1$ that generally corresponds to or slightly exceeds a height (measured from bottom to top) of containers C (illustrated in FIG. 5) or other articles to be accommodated within the carton 150. When cylindrical or substantially cylindrical containers C are used in the carton, the side panels 30 (as well as the side panels 10) can have, for example, a width $W_2$ that generally corresponds to or slightly exceeds an integral multiple of a largest (e.g., "characteristic") diameter of the containers C. The length $L_1$ of the panels 30 can also generally correspond to or slightly exceed an integral multiple of the characteristic diameter. The length $L_1$ will approximate the height of the carton in its dispensing configurations (FIGS. 6 and 7). If multiple generally cylindrical containers C, such as beverage containers, are to be accommodated in the carton, it may be expected that the generally cylindrical containers will share at least one substantially equal common largest diameter.

An exemplary method of erection of the carton 150 is discussed below with reference to FIGS. 1 and 2.

Referring to FIG. 1, the carton 150 may be erected from the blank 8 by folding the blank flat at each of the transverse fold lines 21, 41 so that the underside of the fourth side panels 40 can be glued or otherwise adhered to the glue flap 50. The distal end of the third tear feature 80 is adhered to the distal end of the first tear feature 70 in the adhesive flap 50 so that they may act in unison. The side panels 10, 20, 30, 40 may then be opened to a generally tubular or sleeve form.

Each end of the generally tubular sleeve form may be closed, for example, by folding the end flaps 22, 42 inwardly across the open end, followed by inwardly folding the end flap 12, then folding the end flap 32 inwardly. At each end of the tubular carton form, the interior side of each end flap 12 can be adhered to the end flaps 22, 42, and the interior side of each end flap 32 can be adhered to one or more of the end flaps 12, 22, 42. Substantially cylindrical containers C or other articles, for example, may be loaded into the tubular sleeve in a conventional manner at any time before one or both ends of the carton are closed by the end flaps 12, 22, 32, 42. In the exemplary embodiment, the carton 150 accommodates twelve containers C in two rows and six columns.

Figure 2:
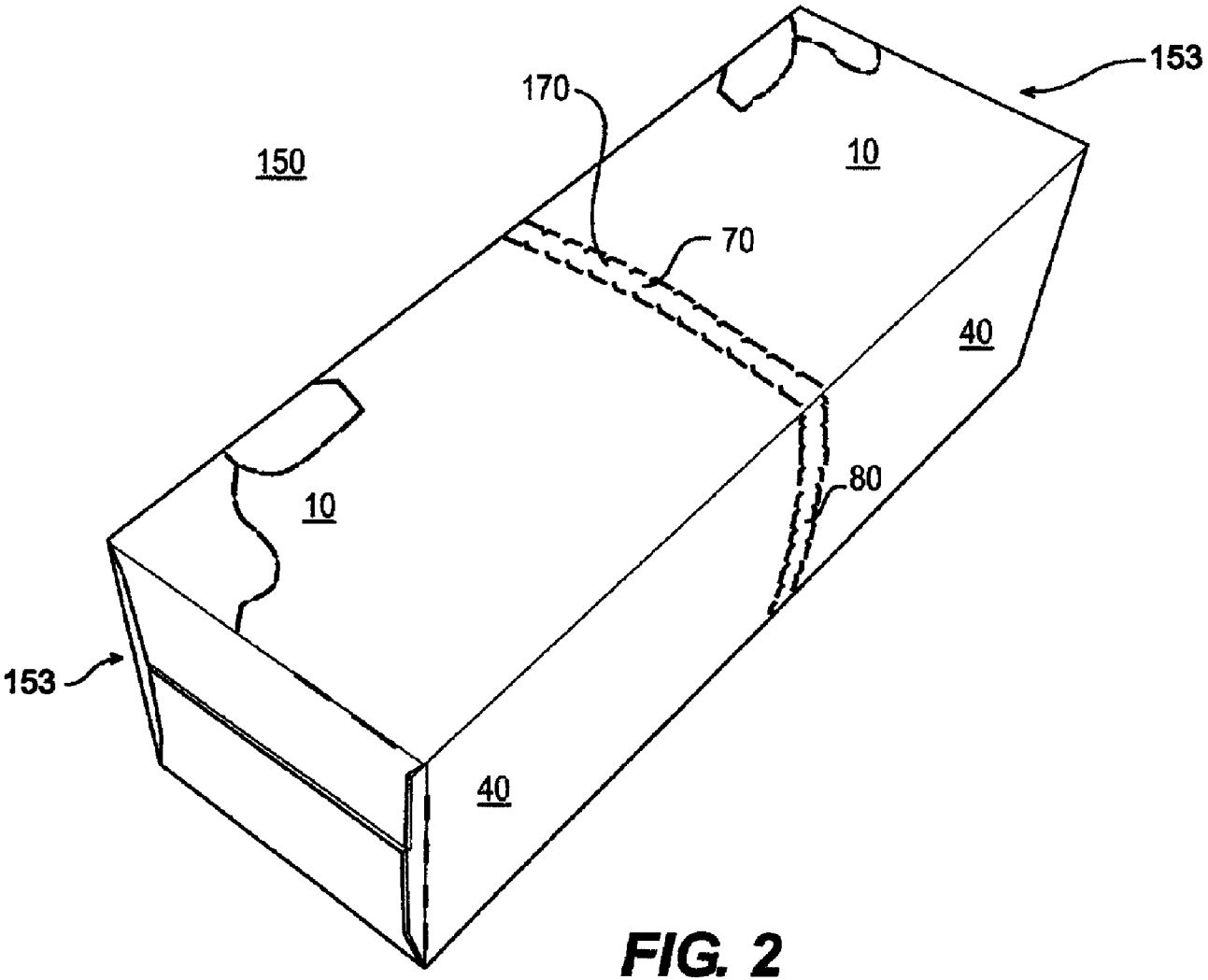
FIG. 2 illustrates the first carton embodiment.

FIG. 2 is a perspective view of the carton 150 erected from the blank 8 illustrated in FIG. 1. In the erected carton 150, the overlapped end flaps 12, 22, 32, 42 form an end panel 153 at each end of the carton 150. With the ends closed, the carton 150 has a substantially parallelepipedal shape. The sequentially arranged tear features 70, 80 extend partially around the perimeter of the carton 150 (e.g., around three side of the carton) and comprise a tear strip 170.

Figure 3:
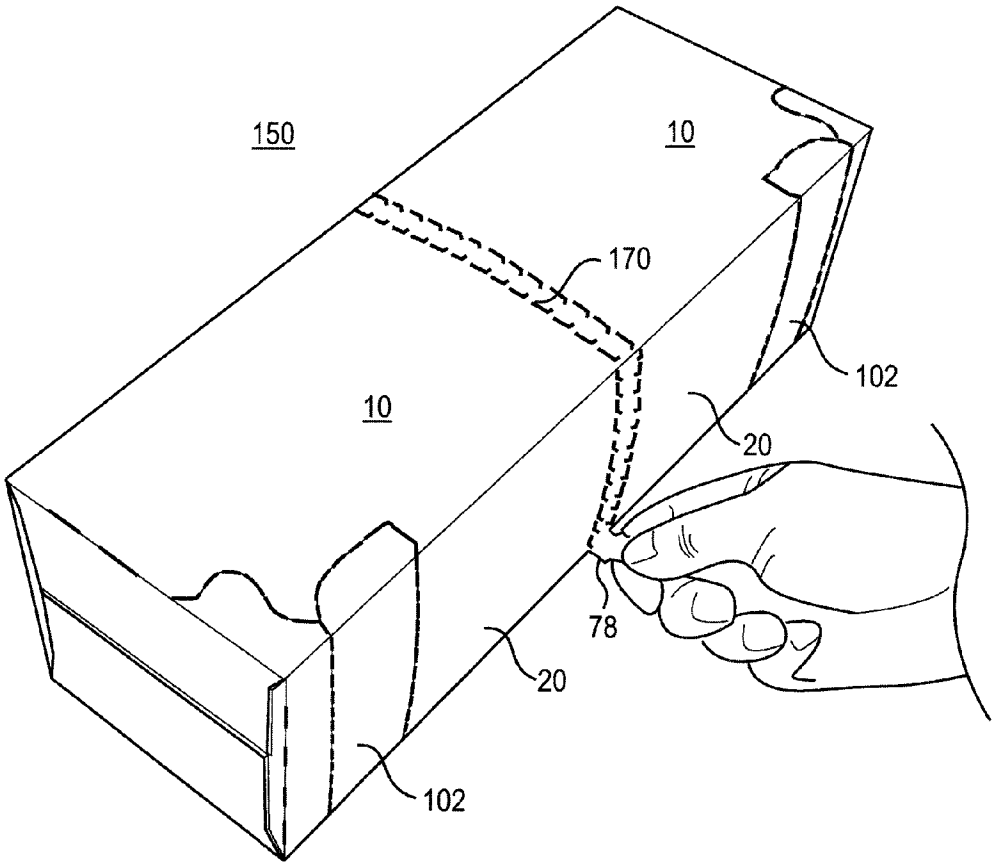
FIGS. 3-5 illustrate placing the first carton embodiment into a first dispensing configuration.
Figure 4:
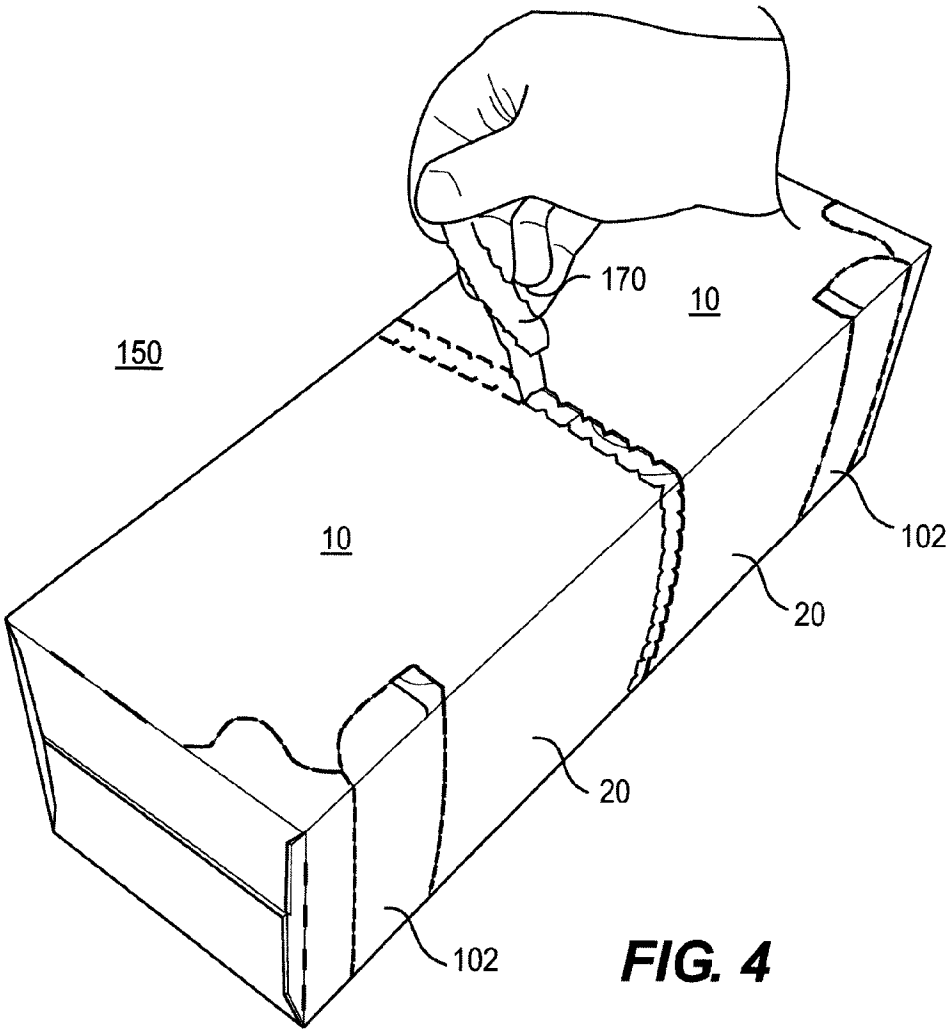
Figure 5:
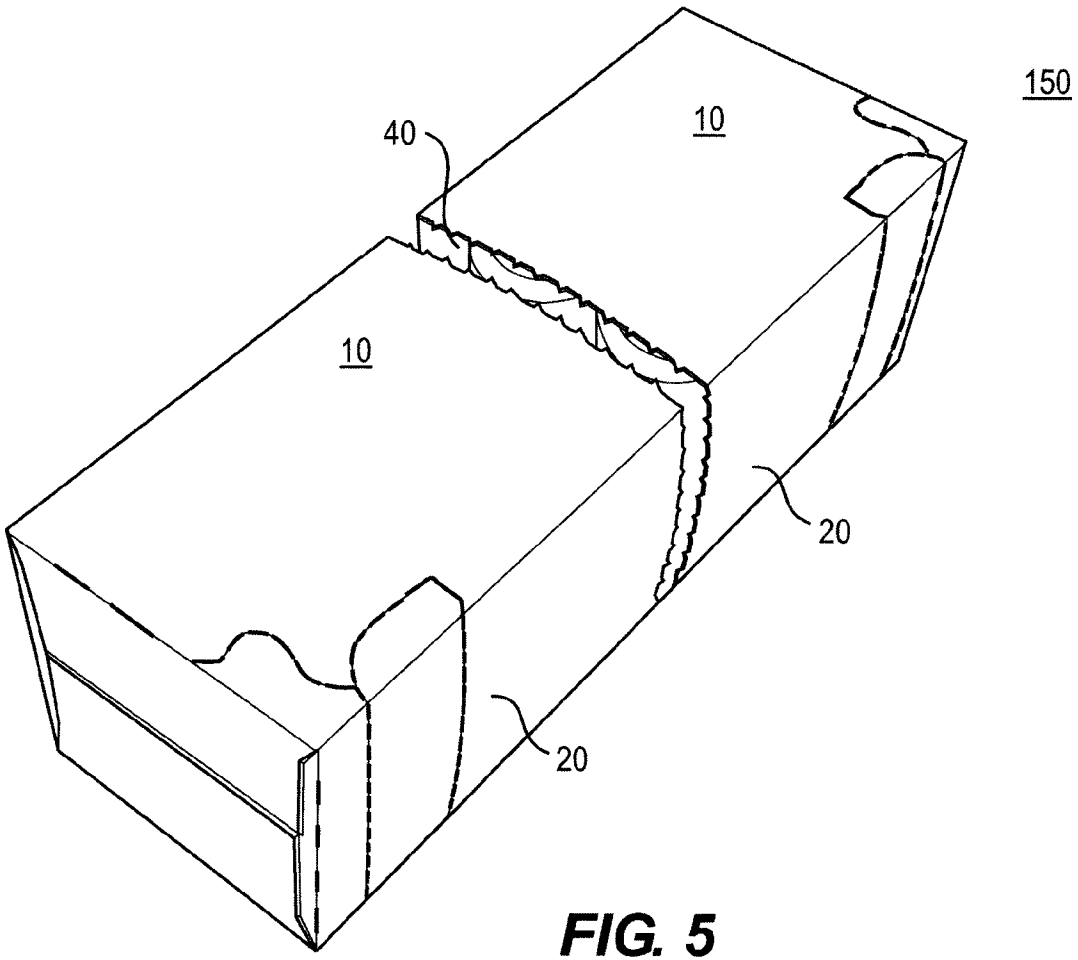

FIGS. 3-5, discussed in detail below, illustrate an exemplary method of placing the carton 150 into a first dispensing configuration.

Referring to FIG. 3, the tear strip 170 is grasped at the tear tab 78 and pulled so that the tear strip 170 is torn along the tear lines 72 (illustrated in FIG. 1). Referring to FIG. 4, the tear strip 170 is further torn to separate the side panels 20 and then the side panels 10. As shown in FIGS. 1 and 2, the second tear feature 80 is adhered to the first tear feature 70 so that the tearing motion causes the second tear feature 80 to tear along the tear lines 82 and thereby separate the side panels 40. FIG. 5 illustrates the carton 150 with the tear strip 170 fully removed from the carton.

Referring to FIG. 6, the carton is folded or pivoted about the longitudinal hinge line 68 so that the third side panels 30 are adjacent to one another. The carton is now in a first dispensing configuration comprising of a pair of hingedly connected, side-by-side carton sections 162 having dispenser openings 164 at the top of each section, and is designated by the reference numeral 160.

In the first dispensing configuration, each section 162 of the carton 160 accommodates six generally cylindrical containers C, arranged in two rows and three columns In FIG. 6, the containers C are lying on their curved side surfaces, with longitudinal axes of the containers C being parallel to or aligned with a support surface of the sections 162, and aligned with the plane of the end panels 153 (FIG. 2). The longitudinal axes of the containers C, which pass through the bottom ends of the containers C, are transverse to the hinge line 68. The containers C are accessible through the dispenser openings 164. In the illustrated embodiment, the side-by-side carton sections 162 are identical or substantially identical. Variations may be introduced, however, to one or both of the sections 162 so that they are not identical. For example, the upper perimeter edge of the dispenser opening 164 of one or both of the carton sections 162 could be varied by changing the shape of one or more of the tear features 70, 80.

Referring to FIGS. 6 and 7, the carton 150 is placed in a second dispensing configuration by removing one or both of the dispenser sections 102 from the carton sections 162. As shown in FIG. 7, the containers C can now be pulled through dispenser openings 168 left after removing the dispenser sections 102, and/or through the dispenser openings 164 at the top of each carton section 162. The dispenser openings 168 are located at bottom portions of the carton sections 162 so that the containers C can be gravity-fed to a dispensing position at the openings 168. As shown in FIG. 7 a portion 128 of the second side panel 20 is located between each of the dispenser openings 168 and a respective end panel 160. Each of the portions 128 is a retention feature of the carton 150 that prevents premature withdrawal of a container C through a respective dispenser opening 168.

In the illustrated embodiment, the carton sections 162 are hingedly connected while in the dispensing configuration, wherein the carton 150 is torn along three sides while a fourth side of the carton remains intact. In an alternative embodiment, the carton sections 162 may be separated from one another along the hinge 68 (e.g., by replacing the hinge with a breachable line of disruption) so that the carton is separated along four sides in order to place the carton 150 in the dispensing configurations.

EXAMPLE 1

A parallelepipedal carton 150 as illustrated in FIG. 2 accommodates twelve, 12 fluid ounce, cylindrical containers C in a 2×6×1 arrangement. The width $W_1$ is about 4-⅞ in., and the width $W_2$ is about 5-⅛ in. The length $L_1$ is about 7-¾ in. In the dispensing configurations, each carton section 162 (FIG. 6) accommodates six containers C in a 2×3×1 arrangement.

In the above embodiments, the exemplary carton is described as accommodating twelve, 12-ounce, cylindrical beverage containers C in a 2×6×1 configuration. Other arrangements of containers, packages, articles, and other items, however, can be accommodated within a carton constructed according to the principles of the present invention. For example, a carton constructed according to the principles of the present invention would also function satisfactorily if the carton were sized and shaped to hold articles in other configurations, such as 2×4×1, 2×8×1, 3×4×1, 3×6×1, 4×4×1, 4×6×1, etc., and multi-tier variations of the aforementioned configurations.

The dimensions of the exemplary blank may be altered, for example, to accommodate various container forms. For example, 16-ounce or 20-ounce petaloid bottles, or other beverage bottles having longitudinal axes, may be accommodated within cartons constructed according to the principles of the present invention. In such arrangements, the first or bottom ends of the bottles could be adjacent to the second or fourth side panel pairs.

In accordance with the exemplary embodiments, the blank may be constructed of paperboard. The blank can also be constructed of other materials, such as cardboard, hard paper, solid unbleached sulfate (SUS) board, or any other material having properties suitable for enabling the carton to function as described above. The blank can also be laminated to one or more sheet-like materials at selected panels or panel sections.

The interior and/or exterior sides of the blank can be coated with a clay coating. The clay coating may then be printed over with product, advertising, price coding, and other information or images. The blank may then be coated with a varnish to protect any information printed on the blank. The blank may also be coated with, for example, a moisture barrier layer, on either or both sides of the blank.

For purposes of the description presented herein, the term "line of disruption" can be used to generally refer to cut lines, tear lines, crease lines, score lines, and fold lines (or overlapping and/or sequential combinations of at least one cut line, crease line, score line, tear line, or fold line). A "breachable line of disruption" is a line of disruption that is intended to be breached during ordinary use of the carton, such as when placing the carton in a dispensing configuration. An example of a breachable line of disruption is a tear line.

In accordance with the above-described embodiments of the present invention, a fold line can be any substantially linear, although not necessarily straight, line of disruption or other form of weakening that facilitates folding therealong. More specifically, but not for the purpose of narrowing the scope of the present invention, fold lines include: score lines; cuts that extend partially into a material along the desired line of weakness, and/or a series of cuts that extend partially into and/or completely through the material along the desired line of weakness; and various overlapping and/or sequential combinations of these features.

In the present specification, a "panel" or "flap" need not be flat or otherwise planar. A "panel" or "flap" can, for example, comprise a plurality of interconnected generally flat or planar blank sections.

The above embodiments may be described as having one or more panels adhered together by glue during erection of the carton embodiment. The term "glue" is intended to encompass all manner of adhesives commonly used to secure carton panels in place.

It will be understood by those skilled in the art that while the present invention has been discussed above with reference to exemplary embodiments, various additions, modifications and changes can be made thereto without departing from the spirit and scope of the invention as set forth in the following claims.

What is claimed is:

1. A method of dispensing beverage containers from a carton, comprising:

providing a substantially parallelepipedal carton having a first side panel, a second side panel foldably attached to the first side panel, a third side panel foldably attached to the second side panel, a fourth side panel foldably attached to the third side panel, at least one end flap foldably connected to at least one of the side panels forming a first end of the carton, at least one end flap foldably connected to at least one of the side panels forming a second end of the carton, and a first dispenser section defined in part by at least one breachable line of disruption, the first dispenser section extends across an entire width of the second side panel and comprises at least a portion of at least one of the first and third side panels, the carton comprising a tear feature extending across at least the first side panel, the second side panel, and the fourth side panel and a hinge extending across at least the third side panel, the tear feature comprising a first tear feature extending across the first and second side panels, and a second tear feature extending across the fourth side panel, the hinge extending from respective ends of the first and second tear features;

providing a plurality of beverage containers accommodated in the carton in at least two rows and at least two columns;

separating the carton at at least three of the sides into a first carton section and a second carton section, the separating the carton comprising tearing the carton at the tear feature to divide each of the first side panel, the second side panel, and the fourth side panel into respective first and second portions, the first portions of the first side panel, the second side panel, and the fourth side panel comprising the first carton section and the second portions of the first side panel, the second side panel, and the fourth side panel comprising the second carton section;

pivoting the first and second carton sections at the hinge to place the first and second carton sections in a side-by-side configuration, wherein the first carton section accommodates a first plurality of the plurality of beverage containers and has a first open top through which the first plurality of beverage containers can be dispensed, the first open top being at a top end of the first carton section opposite to the first end of the carton, the second carton section accommodates a second plurality of the plurality of beverage containers and has a second open top through which the second plurality of beverage containers can be dispensed, the second open top being at a second top end of the second carton section opposite to the second end of the carton, and the first dispenser section is located in the first carton section;

opening the first dispenser section; and removing at least one of the first plurality of beverage containers through the opened first dispenser section.

2. The method of claim 1, wherein the first dispenser section is adjacent to the first end of the carton.

3. The method of claim 2, wherein the beverage containers are generally cylindrical containers.

4. The method of claim 1, wherein separating the carton into the carton sections comprises tearing the tear feature along the three sides of the carton.

5. The method of claim 1, wherein the plurality of beverage containers comprises at least eight beverage containers arranged in at least two rows and at least four columns.

6. The method of claim 1, wherein the beverage containers lie on their sides when the first and second carton sections are in the side-by-side configuration.

7. The method of claim 1, wherein the first and second sections are placed in a side-by-side configuration.

8. The method of claim 1, wherein the first tear feature is a tear strip, the second tear feature is a tear strip, and the hinge is a fold line.

9. The method of claim 1 wherein the carton has an adhesive flap foldably connected to the first side panel that is adhesively secured and overlapped by the fourth side panel.

10. The method of claim 9 wherein the first side panel, the second side panel, the third side panel, and the fourth side panel each respectively comprise end flaps that respectively close ends of the carton.

11. The method of claim 1 wherein the at least one breachable line of disruption that defines the first dispenser section is located in the first portion of the second side panel and is spaced apart from the first end of the carton such that a portion of the second side panel is located between the first dispenser section and the first end of the carton.

12. A method of dispensing beverage containers from a carton, comprising:

providing a carton having a first side panel, a second side panel foldably attached to the first side panel, a third side panel foldably attached to the second side panel, a fourth side panel foldably attached to the third side panel, at least one end flap foldably connected to at least one of the side panels forming a first end of the carton, at least one end flap foldably connected to at least one of the side panels forming a second end of the carton, and a first dispenser section, the first dispenser section extends across an entire width of the second side panel and comprises at least a portion of at least one of the first and third side panels, the carton comprising a tear feature extending across at least the first side panel, the second side panel, and the fourth side panel and a hinge extending across at least the third side panel, the tear feature comprising a first tear feature extending across the first and second side panels, and a second tear feature extending across the fourth side panel, the hinge extending from respective ends of the first and second tear features;

providing at least twelve beverage containers accommodated in the carton in at least three rows and at least four columns, each beverage container having a longitudinal axis, a container side, a first container end, and a second container end;

separating the carton into a first carton section and a second carton section so that the first and second carton sections remain hingedly attached at the hinge on one side of the carton, the separating the carton comprising tearing the carton at the tear feature to divide each of the first side panel, the second side panel, and the fourth side panel into respective first and second portions, the first portions of the first side panel, the second side panel, and the fourth side panel comprising the first carton section and the second portions of the first side panel, the second side panel, and the fourth side panel comprising the second carton section;

pivoting the first and second carton sections at the hinge to place the first and second carton sections in a side-by-side configuration, wherein the first carton section accommodates a first half of the at least twelve beverage containers and has a first open top through which the first half of the beverage containers can be dispensed, the first open top being at a top end of the first carton section opposite to the first end of the carton, the first dispenser section is located in the first carton section adjacent to the first end of the carton and is defined in part by a first plurality of breachable lines of disruption, and the second carton section accommodates a second half of the at least twelve beverage containers and has a second open top through which the second half of the beverage containers can be dispensed, the second open top being at a second top end of the second carton section opposite to the second end of the carton; and removing at least one of the first half of the beverage containers from the first carton section.

13. The method of claim 12, further comprising opening the first dispenser section.

14. The method of claim 13, wherein beverage containers in a bottom column of the first half of the beverage containers rest on their sides on the first end of the carton.

15. A method of dispensing beverage containers from a carton, comprising:

providing a substantially parallelepipedal carton having a first side panel, a second side panel foldably attached to the first side panel, a third side panel foldably attached to the second side panel, a fourth side panel foldably attached to the third side panel, at least one end flap foldably connected to at least one of the side panels forming a first end of the carton, at least one end flap foldably connected to at least one of the side panels forming a second end of the carton, and a first dispenser section, the first dispenser section extends across an entire width of the second side panel and comprises at least a portion of at least one of the first and third side panels, the carton comprising a tear feature extending across at least the first side panel, the second side panel, and the fourth side panel and a hinge extending across at least the third side panel, the tear feature comprising a first tear feature extending across the first and second side panels, and a second tear feature extending across the fourth side panel, the hinge extendin from respective ends of the first and second tear features;

providing at least eight beverage containers accommodated in the carton in at least two rows and at least two columns;

tearing a tear feature to separate the carton at at least three of the sides into a first carton section and a second carton section, the tearing a tear feature comprising tearing the carton at the tear feature to divide each of the first side panel, the second side panel, and the fourth side panel into respective first and second portions, the first portions of the first side panel, the second side panel, and the fourth side panel comprising the first carton section and the second portions of the first side panel, the second side panel, and the fourth side panel comprising the second carton section;

pivoting the carton sections about the hinge, which connects the first and second carton sections to place the first and second carton sections in a side-by-side configuration, wherein the first carton section accommodates a first half of the at least eight beverage containers and has a first open top through which the first half of the beverage containers can be dispensed, the first open top being at a top end of the first carton section opposite to the first end panel of the carton, the second carton section accommodates a second half of the at least eight beverage containers and has a second open top through which the second half of the beverage containers can be dispensed, the second open top being at a top end of the second carton section opposite to the second end panel of the carton, articles in a bottom column of the first half of the beverage containers rest on their sides on the first end panel of the carton, and articles in a bottom column of the second half of beverage containers rest on their sides on the second end panel of the carton;

opening the first dispenser section; and removing at least one of the first half of the beverage containers through the opened first dispenser section.

16. The method of claim 15, wherein the beverage containers are generally cylindrical containers.

* * * * *